US008316765B2

(12) United States Patent
Blanks

(10) Patent No.: US 8,316,765 B2
(45) Date of Patent: Nov. 27, 2012

(54) CARRIER DEVICE FOR CARRYING MARKER ELEMENTS

(75) Inventor: Steven Blanks, Manchester (GB)

(73) Assignee: Hellermanntyton Limited, West Sussex (GB)

( * ) Notice: Subject to any disclaimer, the term of this patent is extended or adjusted under 35 U.S.C. 154(b) by 987 days.

(21) Appl. No.: 11/913,040

(22) PCT Filed: Apr. 28, 2006

(86) PCT No.: PCT/GB2006/001572

§ 371 (c)(1),
(2), (4) Date: Mar. 19, 2008

(87) PCT Pub. No.: WO2006/117528

PCT Pub. Date: Nov. 9, 2006

(65) Prior Publication Data

US 2008/0267686 A1 Oct. 30, 2008

(30) Foreign Application Priority Data

Apr. 29, 2005 (GB) ..... 0508728.3
Oct. 10, 2005 (GB) ..... 0520474.8

(51) Int. Cl.
*B65D 21/02* (2006.01)
*B65D 21/032* (2006.01)

(52) U.S. Cl. ..... 101/35; 206/747; 206/748; 206/503; 206/509; 220/4.27; 220/23.88; 211/78; 211/194

(58) Field of Classification Search ..... 206/736, 206/745, 747, 748, 503, 505, 507, 509, 821, 206/345; 220/4.26, 4.27, 23.88; 211/71.01, 211/78, 126.1, 126.2, 163, 194; 101/35, 101/41, 477, 4, 8, 32; 400/531; 281/2
See application file for complete search history.

(56) References Cited

U.S. PATENT DOCUMENTS

| | | | | | |
|---|---|---|---|---|---|
| 183,232 | A | * | 10/1876 | Trautmann | 206/748 |
| 3,188,157 | A | * | 6/1965 | Rand | 312/202 |
| D267,153 | S | * | 12/1982 | Lebowitz | D19/77 |
| 4,560,078 | A | * | 12/1985 | Dubuisson | 220/4.26 |
| 4,655,129 | A | | 4/1987 | Wirth et al. | |
| 4,807,773 | A | * | 2/1989 | Tsai | 220/4.27 |
| 4,815,483 | A | * | 3/1989 | DuGrenier et al. | 132/295 |
| 5,423,434 | A | * | 6/1995 | Chen | 211/40 |
| D534,318 | S | * | 12/2006 | Ditrichstein | D28/78 |

FOREIGN PATENT DOCUMENTS

FR 2114969 A 6/1972

(Continued)

OTHER PUBLICATIONS

International Search Report, Apr. 2, 2007, pp. 1-5.
European Patent Office, "PCT Written Opinion of the International Searching Authority," Jan. 11, 2006 and Jan. 31, 2006, pp. 1-12.
http://www.partex.co.uk/markties.html#ident, "A solid identity tag which can be used as a marker for cables."

(Continued)

*Primary Examiner* — Leslie J Evanisko
(74) *Attorney, Agent, or Firm* — John K. Fitzgerald; Fulwider Patton LLP

(57) ABSTRACT

A marker carrier device has carrier elements for carrying respective markers, the device being re-configurable between a compact configuration and a selection configuration in which the markers are accessibly presented for selection. Carrier devices loaded with markers are received at a receiving station of a marking unit. The markers are selected from the carrier individually whilst in the marking unit and marked by a marking device with a predetermined indicium.

13 Claims, 9 Drawing Sheets

FOREIGN PATENT DOCUMENTS

| | | | |
|---|---|---|---|
| GB | 750670 | A | 6/1956 |
| GB | 2137586 | A | 10/1984 |
| GB | 2425646 | A | 1/2006 |
| JP | 2003107998 | A | 4/2003 |
| WO | 02063594 | A | 8/2002 |
| WO | 02095890 | A | 11/2002 |

OTHER PUBLICATIONS http://www.canford.co.uk/commerce/resources/catdetails/2350.pdf, "A holder for reels of cable marking plastic."

http://www.partex.co.uk/cas.html, "A hinged cassette dispenser for cable markers."

* cited by examiner

CARRIER DEVICE FOR CARRYING MARKER ELEMENTS

RELATED APPLICATIONS

This is a U.S. national phase application of PCT/GB2006/001572 (WO 2006/117528 A2), filed Apr. 28, 2006, which claims priority to United Kingdom Application No. 0508728.3, filed Apr. 29, 2005 and United Kingdom Application No. 0520474.8, filed Oct. 10, 2005.

BACKGROUND

The present invention relates to a marker system and a carrier device for carrying individual pre-formed markers.

Elongate marker strips of plastics, metal or other materials are known for the purpose of identifying, for example electric cables. The markers are typically printed or embossed with an identifier indicia and attached to the cable, in order to identify the relevant cable.

An improved marker system and carrier device for such markers have been devised.

SUMMARY OF THE INVENTION

According to a first aspect, the present invention provides a carrier device for marker elements, the carrier device comprising a plurality of carrier elements for carrying respective marker elements, the device being re-configurable between a compact configuration and a selection configuration in which the markers are accessibly presented for selection.

It is preferred that the marker elements are presented in a fanned out configuration in the selection configuration, and in a non fanned out configuration in the compact configuration. Beneficially, the marker elements are presented in a radially spaced array in the selection configuration. The carrier elements preferably interlock one another in the compact configuration.

The carrier elements are preferably rotatable relative to one another to move between the compact configuration and the selection configuration.

Desirably, the carrier elements are arranged in a stack or row when in the compact configuration.

It is preferred that the system includes detent means for retaining the carrier elements interlocked in the compact configuration. Advantageously, the carrier elements are provided with complementary engaging formations comprising the detent means. It is desirable that the detent means is capable of being overcome by hand force in order to move the carrier elements from the compact position.

The carrier elements preferably include grip means for retaining the respective marker elements. The grip means may comprise one or more resilient clamp elements provided for a respective carrier element. The clamp element is preferably biassed to a normally clamped position.

Typically, the carrier elements and the marker elements are elongate and the carrier elements are configured to facilitate insertion and removal of the marker elements in a transfer direction which is transverse to the longitudinal direction. Preferably the carrier elements are rotatable about a common pivot spine. Beneficially the common pivot spine is positioned proximate one end of the respective carrier elements.

It is a preferred feature of the arrangement that the marker elements can be removed from the respective carrier elements in both the compact and the selection configuration. This aids in automatic handling such as for example enabling the marker elements to be picked from the device when in the compact configuration, loaded in a printing or embossing device.

The carrier elements are configured, beneficially, to receive a single marker element. Desirably, the marker elements are substantially laid flat received on a support of the respective carrier element.

According to an alternative aspect, the present invention provides a marker system for marking preformed markers the marker system including:

- a marker carrier device for carrying a plurality of markers received in respective carrier elements comprising the marker carrier device;
- a marking unit including:
  - a receiving station for receiving the marker carrier device;
  - a marking device; and,
  - means for selecting individual marker elements in the carrier device and operating the marking device to mark the respective marker element with a predetermined indicium.

It is preferred that the marking unit includes a picker arrangement to remove the marker elements from the carrier device and present the respective marker elements to the marking device.

Beneficially, the respective marker elements are returned to the carrier device following marking.

Desirably, the system is programmable to predetermine the indicium applied to a respective marker. Beneficially the system therefore includes user input means (such as a keypad or the like) to determine the indicium applied to the marker element.

The marking device preferably comprises an embossing device arranged to impart an embossed indicium to the marker element.

The carrier device preferably comprises a plurality of movable carrier elements re-configurable between a compact configuration and a selection configuration in which the markers are accessibly presented for selection, the carrier elements being moved to the selection configuration to enable the marker elements to be selected for marking in the marking unit.

In one embodiment the carrier device and marking device are sequentially relatively indexed to enable marker elements to be selected for marking. In alternative embodiment the marker carrier device could be indexed. The marked marker elements are preferably returned to the carrier elements from whence they came for dispatch from the unit.

The marker carrier used in the system has preferred and advantageous features in accordance with the marker carrier device according to the first aspect of the invention.

BRIEF DESCRIPTION OF THE DRAWINGS

The invention will now be further described, by way of example only, and with reference to the accompanying drawings, in which.

DETAILED DESCRIPTION OF THE INVENTION

Figure 1:
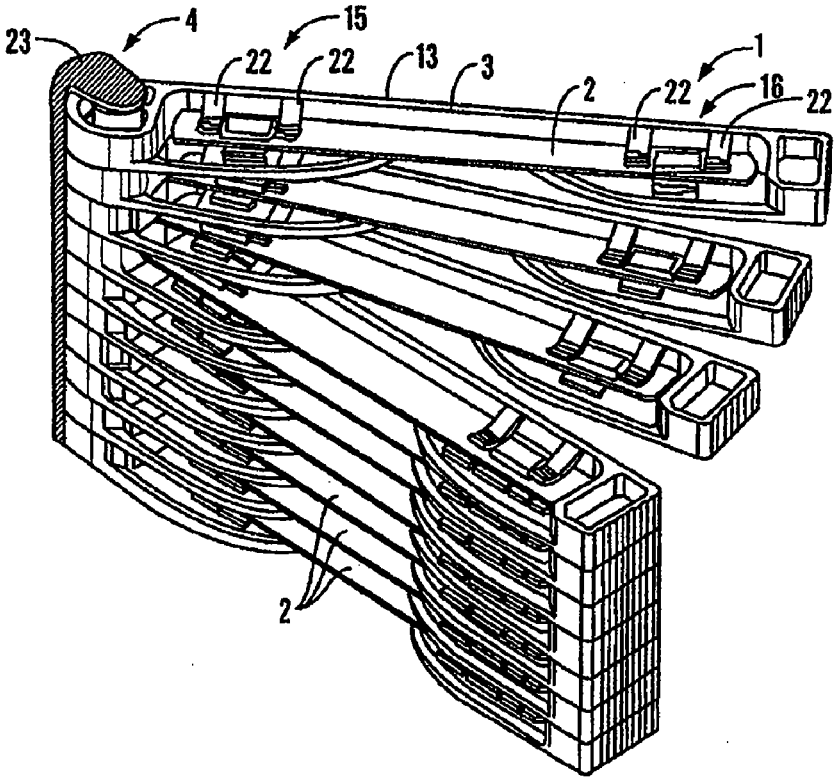
FIG. 1 is a perspective view of a carrier device according to the invention.
Figure 2:
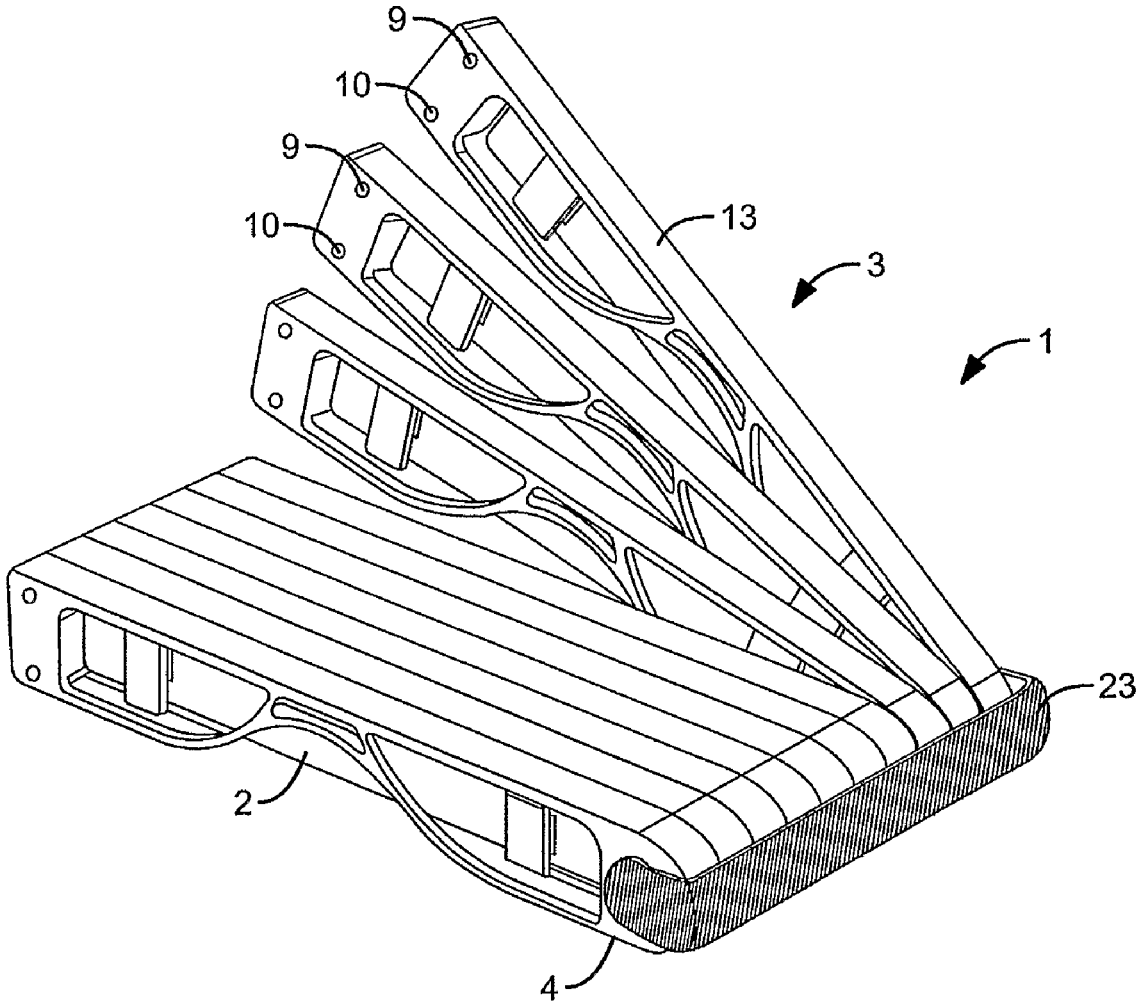
FIG. 2 is an alternative perspective view of the carrier device of FIG. 1.
Figure 3:
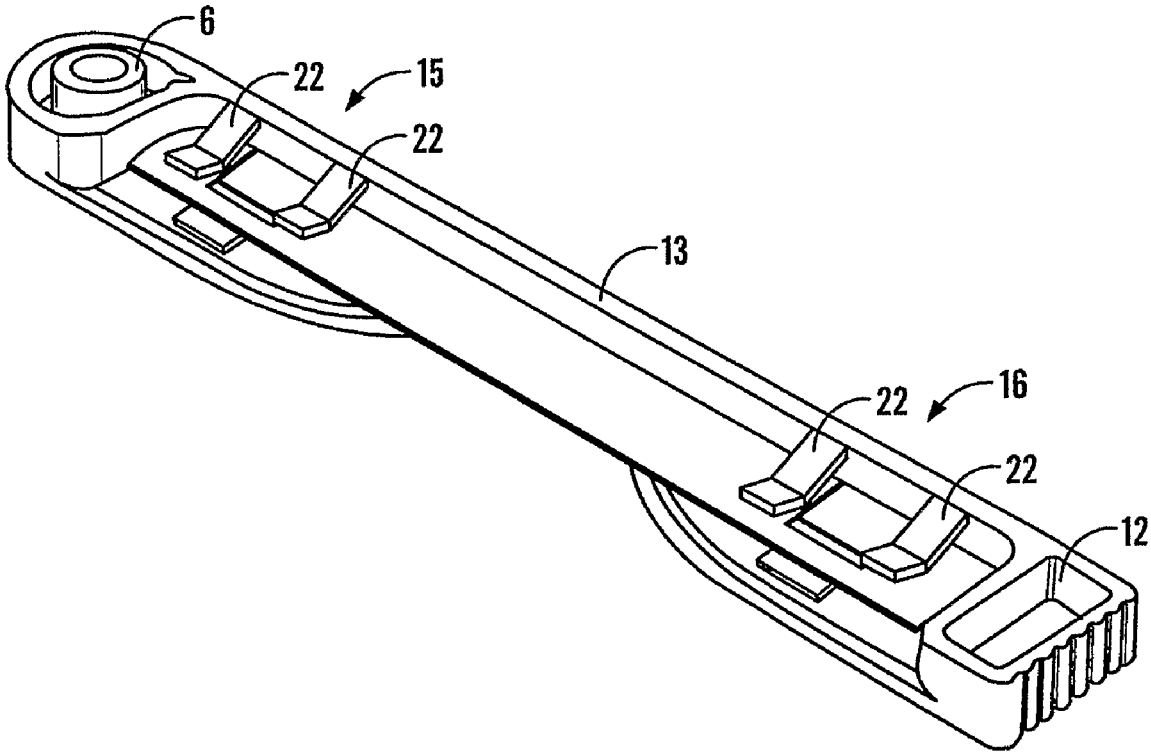
FIG. 3 is a perspective view of a carrier element comprising the carrier device of the preceding figures.
Figure 4:
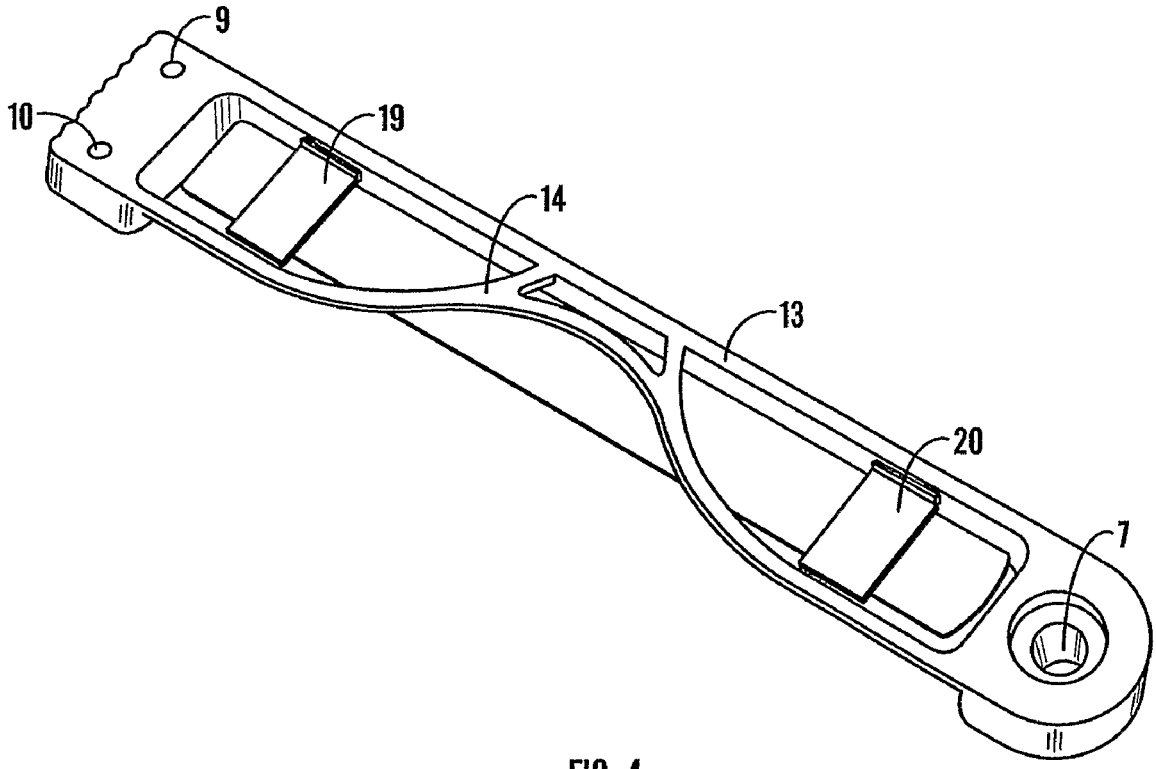
FIG. 4 is an alternative perspective view of the carrier element of FIG. 3.

Referring to the drawings, and initially to FIGS. 1 and 2, there is shown a carrier device 1 for individual selected flat markers 2. The carrier device includes a series of elongate carrier elements 3, each shaped and configured to hold a single respective marker 2. The carrier elements 3 are of plastics material and joined at a common pivotal spine 4 such that each respective carrier element is pivotal relative to others in the device 1. The pivotal spine is formed by boss formations 6 (formed integrally at the ends of respective carrier elements 3), and arranged to rotatably engage with a socket formation 7 provided on the reverse sides of the carrier elements (these are shown most clearly in FIGS. 3 and 4). A resilient plastics clip 23 is used to hold the spine together.

The distal end of the respective carrier elements 3 are provided with detent formations 9, 10 which cooperate with a recess 12 (FIG. 3) formed on the reverse side side of the carrier elements. In this way the adjacent carrier elements 2 can interlock and the carrier device 1 can be held in a compact or closed interlocked configuration in which the carriers are 'in-line' in a row or stack (bottom seven carrier elements in FIG. 1) or 'fanned out<1> in a pivotally radially spaced 'selection' configuration, in which the markers 2 can be easily seen and selected (upper three carrier elements in FIG. 1). The detent formations are shaped and dimensioned with respect to the recess 12 such that the carrier elements can be held 'in line<1> in the compact configuration, but displaced to the fanned out selection configuration by the user by hand.

The body of the carrier element comprises a longitudinal spine 13 and supports 14, 19, 20 against which the marker element is clamped by means of longitudinally spaced clamps 15, 16. The clamps 15,16 included spaced resilient arms 22 which are shaped and configured to be normally biassed to a position of clamping engagement. As the marker element 2 slides into and out of the clamps 15, 16 the arms 22 resiliently flex. The majority of the upper surface of the markers 2 when clamped to a respective carrier element are visible, which makes correct marker element identification and selection easier.

Figure 5:
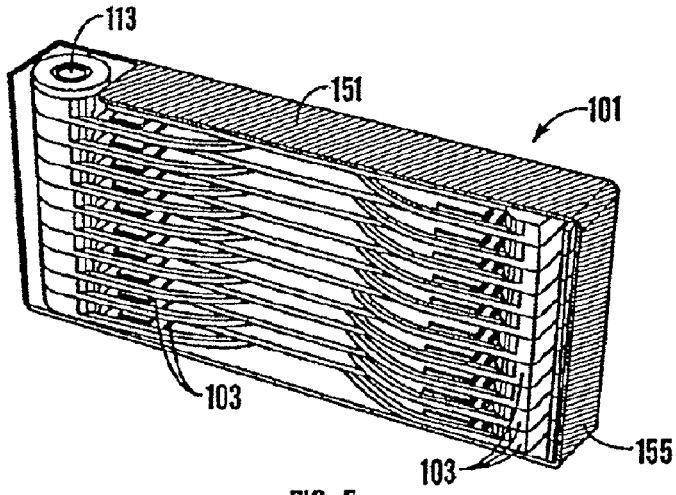
FIGS. 5, 6 and 7 are perspective views of an alternative embodiment of a carrier device in sequential steps between compact configuration and fanned out selection configuration.
Figure 6:
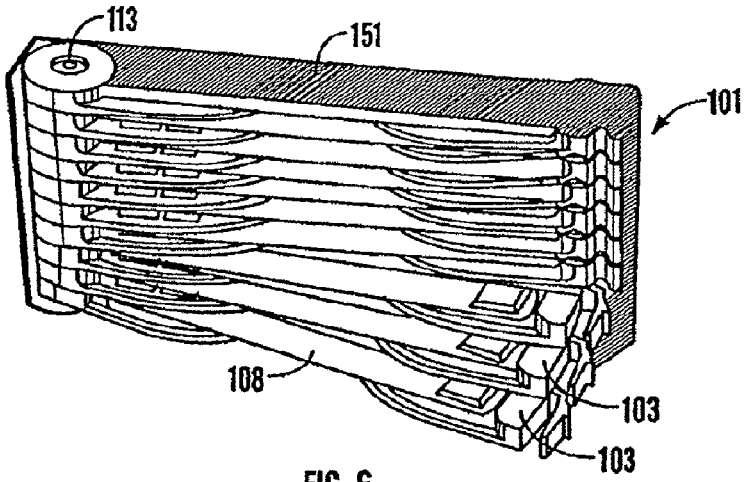
Figure 7:
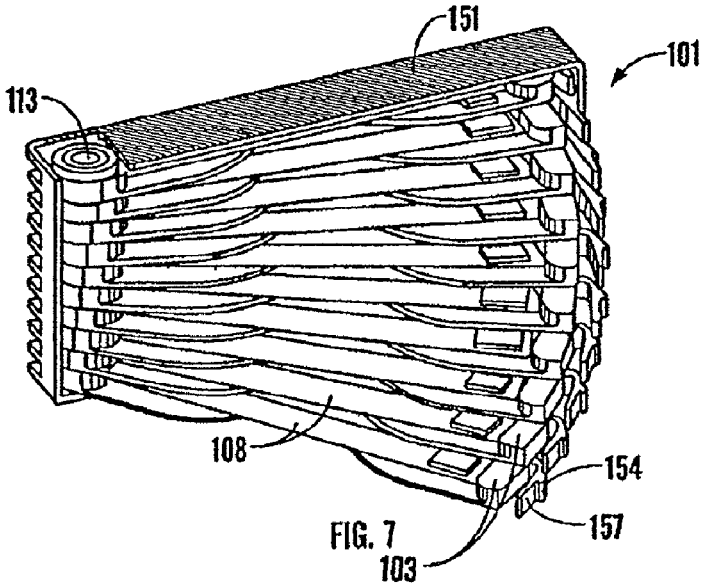
Figure 8:
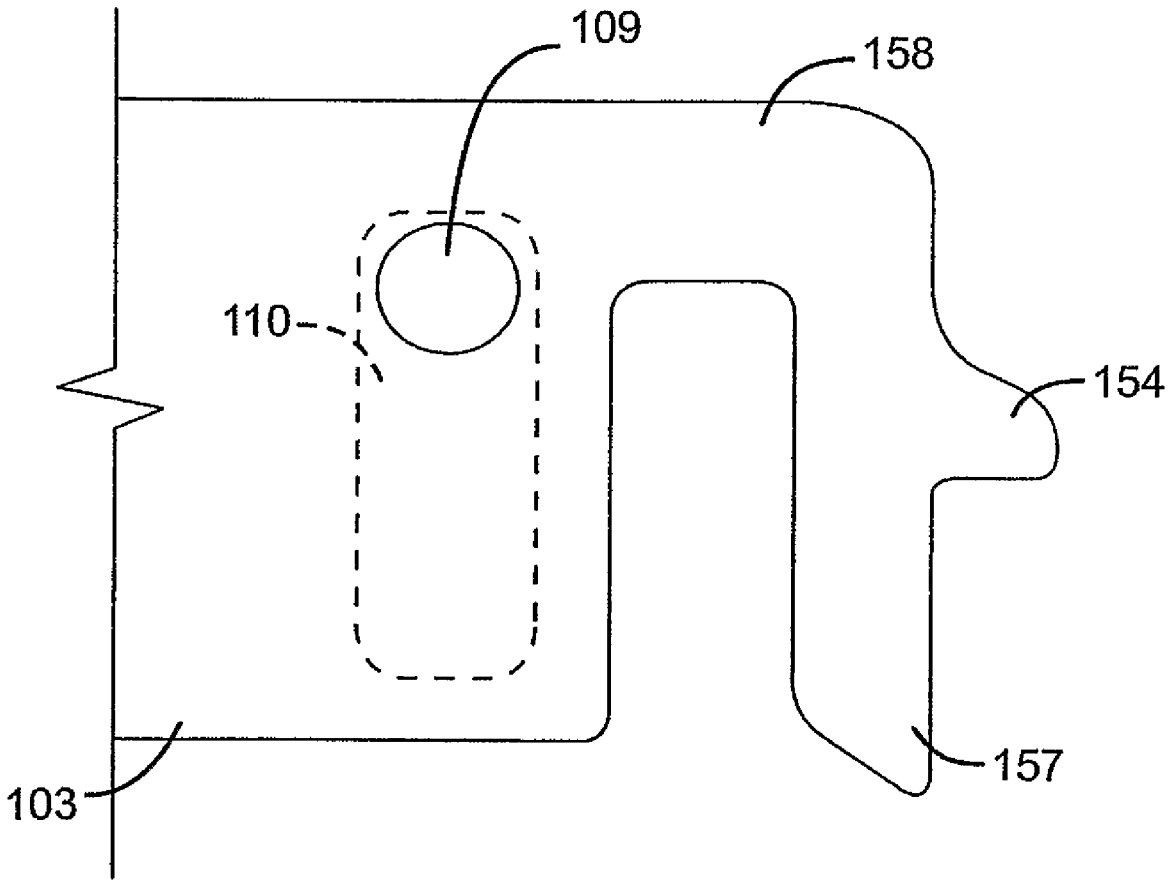
FIG. 8 is a detailed view of an end of a carrier element of the device of FIGS. 5 to 6.
Figure 9A:
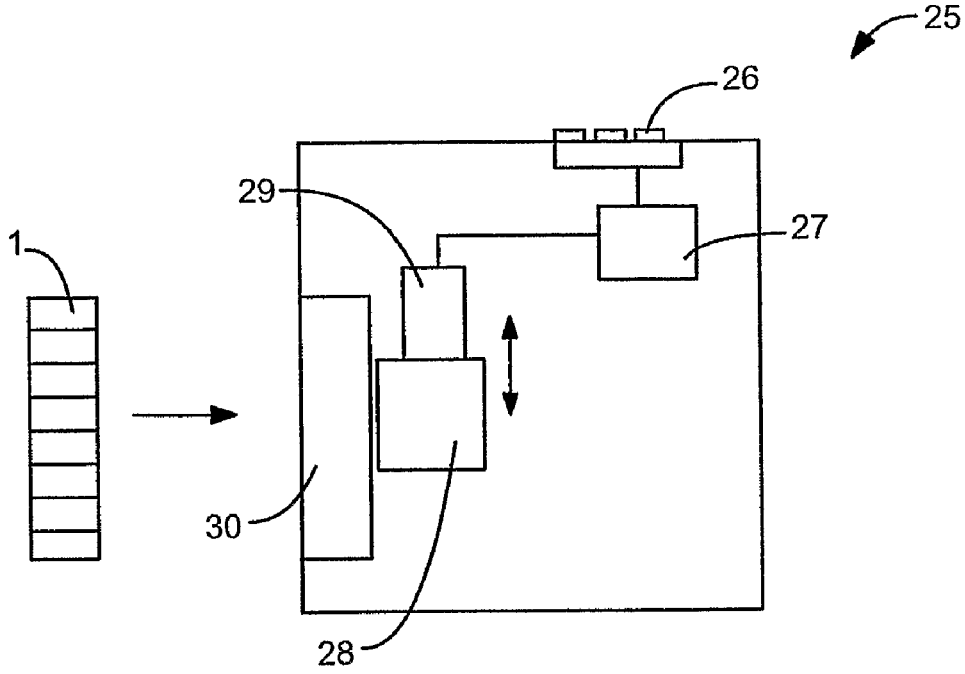
FIGS. 9A and 9B are side and end views respectively of a marker system in accordance with the invention.
Figure 9B:
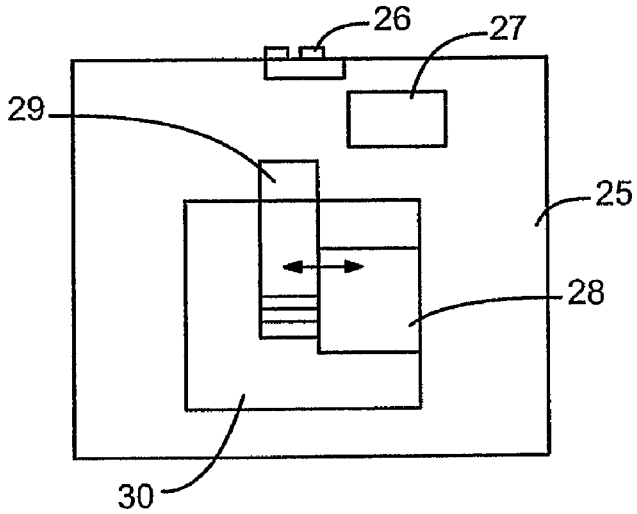

An alternative embodiment of carrier device 101 is shown in FIGS. 5 to 8. The device 101 is generally similar to the device of FIGS. 1 to 4, however in this instance the spines 113 of the carrier elements are mounted pivotally in a housing case 151 within which the carrier elements 103 are received in the compact configuration as shown in FIG. 5. The carrier elements 103 are configured generally as the carrier elements 3 of the previous embodiment except in relation to the free end detail. As shown in FIG. 8, the free end of the carrier elements is provided with a resilient detent 154 to cooperate with a detent shoulder (not shown) on the inside of the distal end wall 155 of the housing case 151. This ensures the carrier elements 103 are generally securely retained within the housing case 151 but permits manual force to move the carrier element pivotally from the housing case 151. The projection 157 carrying the detent 154 enables the user to grip the carrier element for movement, and also provides a resilient connection at bridge portion 158. Projecting upwardly from the distal end of the carrier element 103 is a lug 109 which is arrayed to be received in a slot 110 (shown in dashed line in FIG. 8) which is provided on the underside of the immediately upwardly adjacent carrier element 103 in the stack. In this way, pulling out the lowermost carrier element 103 causes the entire stack of carrier elements 103 to fan out (as shown progressively in FIGS. 6 and 7) as the lugs 109 move in slots 110 and then cause the adjacent carrier to pivotally move (fanning out) when the lug 109 abuts the end of the slot of the respective upwardly adjacent carrier elements 103. In the selection configuration shown in FIG. 7, the carrier elements are fully fanned giving clear view of the markers 108 in the carrier device.

Typically the marker elements are loaded (either manually or mechanically) into the carrier elements 2 of a carrier device 1 in an unmarked state. The unmarked, marker loaded, device is transported to a use location together with a portable marker unit 25 as shown in FIGS. 5A and 5B. The portable marker unit 25 comprises a programmable input device 26 (such as an alpha numeric key pad) and a processor 27. The processor 27 controls a picker device 28 and embossing device 29. The carrier device 1 is loaded into the unit at a docking station 30. The picker device 28 and embossing device 29 are arranged to be indexed upwardly or downwardly to adjacent successive carrier elements 2, and operate to slide out the marker elements 2 from the carrier elements 3 in a direction away from the spine 13. The picker device 28 then transfers the marker element 2 to the embossing device where the appropriate indicia is embossed onto the marker element 2. Subsequently, the marker element is returned by the picker device 28 to the respective carrier element from which it was originally selected.

In a modified embodiment a magazine containing a number of carrier devices 1 (for example ten) can be loaded into a loading station for the unit. A single carrier device 1 is then fed to the docking station 30 for embossing of the blank marker elements 2. In this way the unit can be used for relatively high embossing runs. In addition a separate dispatch station may be provided for the unit. Following embossing of all required marker elements in a relevant carrier 1, the carrier may pass to the dispatch station whilst a further carrier 1 to be concurrently loaded for embossing. The unit may therefore, store and process carriers effectively continuously.

It is possible that alternatively to the picker device 28 and embossing device 29 being moved in indexed fashion, the carrier device 1 could be moved in an indexed manner. The carrier elements 2 of the carrier device 1, when positioned in the docking station 30, could be displaced pivotally to enable easier access for embossing and/or picking. It is also possible for other configurations of carrier device to be used. For example a disc carrier with the marker elements aligned radially could be used. In such an embodiment the disc carrier could be mounted for rotary indexing in the docking station and the marker elements moved radially into and out of the carrier.

Because the system is portable and programmable, markers can be marked up on site with appropriate indicia. The carrier device 1 provides a convenient means of carrying and selecting the markers when in use.

Figure 10:
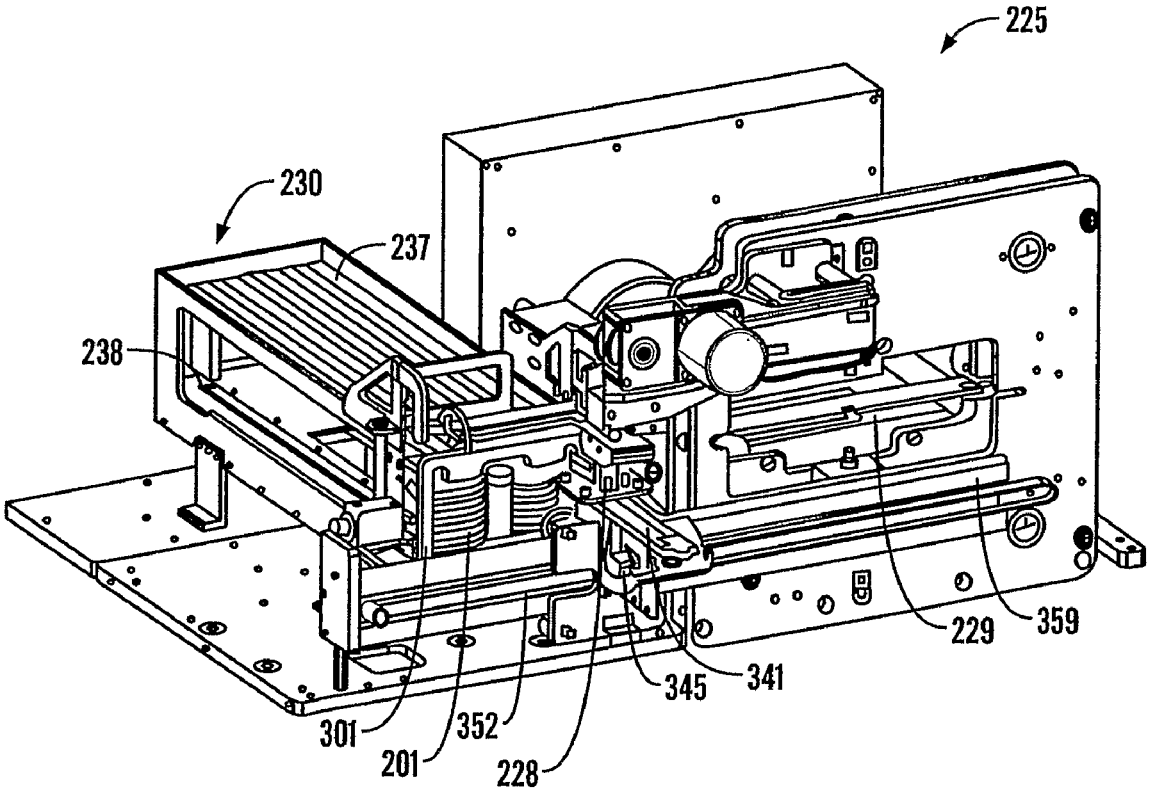
FIG. 10 is a perspective view of an exemplary marker system in accordance with this invention.
Figure 11:
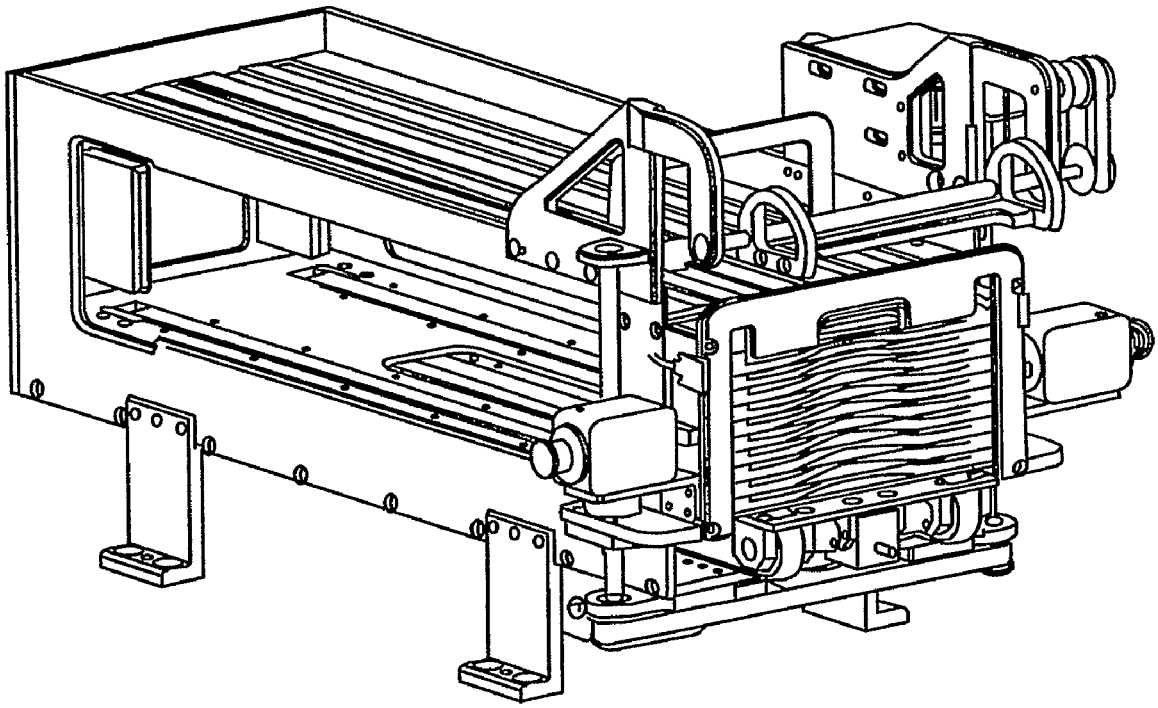
FIG. 11 is a view of a part of the system of FIG. 10.

FIGS. 10 and 11 disclose an alternative exemplary embodiment. In the arrangement shown a portable marker unit 225 includes a magazine 230 having upper and lower racks 237, 238. A bank of carrier devices 201 loaded with unmarked markers is loaded in 5 file (one behind another) onto the lower rack 237. The carrier devices 201 are fed in succession to a forward picking station 301 of the rack. With the carrier device 201 in position at picking station 301 a picker device 228 operates to retrieve individual marker elements, in sequence, from the carrier lo device and transfer them to an embossing station 229 to be marked with the pre-programmed indicia. The picker device 228 includes a conveyor 341 to move toward and away from the carrier device and embossing station, a carriage 345 including an electric motor drive to move the carriage 345 and picker device 228 transversely across the unit supported on a rail 359 between the picking station 301 and the embossing station 229 by means of a conveyor 352.

When each marker in a carrier device 201 has been picked, embossed and returned to the respective carrier device, the carrier device is driven upwardly from the picking station 229 lower rack 238 and loaded onto the upper rack 237, for subsequent onward shipment.

I claim:

1. A portable carrier device for carrying elongate marker elements, the carrier device comprising a plurality of elongate carrier elements for carrying respective elongate marker elements, the elongate carrier elements being reconfigurable between a compact configuration in which the elongate carrier elements are arranged in a stacked arrangement and a fanned out selection configuration in which the upper surface of the marker elements are visible and the marker elements are accessibly presented for selection, the elongate carrier elements having a longitudinal direction along a length of the elongate element and are configured to facilitate insertion and removal of the marker element carried by each elongate carrier element in a transfer direction which is transverse to the longitudinal direction of the carrier element to facilitate removal of the marker element from the elongate carrier element, wherein each of the plurality of carrier elements includes detent means for retaining the carrier elements interlocked with one another in the compact configuration, and the carrier elements are provided with link members arranged to cause the plurality of the carrier elements to move to the fanned out configuration when one carrier element is moved, said link members comprising a lug extending from the distal end of each carrier element that is received in a corresponding slot in the underside of the immediately upwardly adjacent carrier element in the stack, the lugs and slots being arranged such that each lug is slidable within the corresponding slot with the lug causing the upwardly adjacent carrier to move to the fanned out configuration when the lug slides into abutment with the end of said slot.

2. A carrier device according to claim 1, wherein the marker elements are presented in a non-fanned out configuration in the compact configuration.

3. A carrier device according to claim 1, wherein the marker elements are presented in a radially spaced array in the selection configuration.

4. A carrier device according to any preceding claim 1, wherein the carrier elements are rotatable relative to one another to move between the compact configuration and the selection configuration.

5. A carrier device according to claim 1, wherein the carrier elements are provided with complementary engaging formations comprising the detent means.

6. A carrier device according to claim 1, wherein the detent means is capable of being overcome by hand force to move the carrier elements from the compact configuration.

7. A carrier device according to claim 1, wherein the carrier elements include grip means for retaining the respective marker elements.

8. A carrier device according to claim 7, wherein the carrier elements comprise resilient clamp elements, biased to a normally clamped position.

9. A carrier device according to claim 1, wherein the carrier elements and the marker elements are elongate, the carrier elements being rotatable about a common pivot spine.

10. A carrier device according to claim 9, wherein the common pivot spine is positioned at one end of the respective elongate carrier elements.

11. A carrier device according to claim 1, in which the marker elements can be removed from the respective carrier elements in both the compact and the selection configuration.

12. A carrier device according to claim 1, wherein each of the carrier elements are configured to receive a single respective marker element.

13. A carrier device according to claim 1, wherein the marker elements are substantially laid flat received on a support of the respective carrier element.

* * * * *